US007172480B2

(12) United States Patent
Abbott

(10) Patent No.: US 7,172,480 B2
(45) Date of Patent: Feb. 6, 2007

(54) BUNGEE FLIPPER

(75) Inventor: Timothy L. Abbott, Carlsbad, CA (US)

(73) Assignee: Aqua Lung America, Inc., Vista, CA (US)

( * ) Notice: Subject to any disclaimer, the term of this patent is extended or adjusted under 35 U.S.C. 154(b) by 0 days.

(21) Appl. No.: 10/957,099

(22) Filed: Sep. 30, 2004

(65) Prior Publication Data

US 2006/0068659 A1 Mar. 30, 2006

(51) Int. Cl.
*A63B 31/08* (2006.01)

(52) U.S. Cl. ..... 441/64

(58) Field of Classification Search ..... 441/61, 441/64

See application file for complete search history.

(56) References Cited

U.S. PATENT DOCUMENTS

| | | | | |
|---|---|---|---|---|
| 3,082,442 | A | 3/1963 | Cousteau | |
| 3,171,142 | A | 3/1965 | Auzols | |
| 4,737,127 | A | 4/1988 | Lamont | |
| 5,358,439 | A | 10/1994 | Paolo | |
| 5,702,277 | A | 12/1997 | Wagner | |
| 5,810,629 | A | 9/1998 | Parr | |
| 6,364,728 | B1 | 4/2002 | Viale | |
| 6,461,209 | B2 | 10/2002 | Evans | |
| 6,568,974 | B2 | 5/2003 | Semeia | |
| 6,585,548 | B2 | 7/2003 | McCarthy | |
| 6,749,472 | B1 * | 6/2004 | Chen-Lieh | 441/64 |
| 6,814,640 | B1 * | 11/2004 | Houck | 441/64 |
| 2004/0002271 | A1 | 1/2004 | Angelini | |
| 2004/0053547 | A1 | 3/2004 | Godoy | |

* cited by examiner

*Primary Examiner*—Lars A. Olson
(74) *Attorney, Agent, or Firm*—Thomas E. Hilburn; Gordon & Rees, LLP

(57) ABSTRACT

A new swim flipper with a unique blade design is provided. The new swim flipper has a unique joint system portion positioned on the blade of the swim flipper. The new swim flipper will have a joint system portion that has a new combination of materials such as a solid core and a rubber covering that may flex about the joint. The swim flipper eases the pressure on bio-mechanical movement of the ankle, increases the amount of thrust produced by kicking movement of the user. The swim flipper allows the user to expend less energy in attempting to provide adequate thrust to propel the individual through water by using the joint system to adequately produce enough flexibility to propel the individual without excessive force being used.

4 Claims, 3 Drawing Sheets

BUNGEE FLIPPER

FIELD OF THE INVENTION

This invention relates to the field of water flippers. More specifically, this invention relates to a water flipper that allows for increased flexibility/memory of the flipper during use by an individual. Further, this invention relates to a water flipper that allows for a portion of the flipper to be rigid and another portion of the flipper to have a flexible joint contained thereon to allow for increased thrust in water when utilized by an individual.

BACKGROUND OF THE INVENTION

The sport of swimming is considered one of the most beneficial cardiovascular activities available for those interested in gaining cardiovascular support and development. Swimming is easy on the joints and provides low resistance and friction to the body of the individual involved. However, the majority of recreational swimmers do not have the power and dexterity in their large lower extremities to power their way through water at an efficient rate.

Swim flippers and/or swim fins take a considerable amount of the increased load and/or force required by the individual to induce fluidity through the water. However, certain types of swimming fins and/or flippers may add more resistance during use. Moreover, certain swim flippers and/or fins may create additional physical strain and an even more intense workout without greater fitness benefits. Moreover, certain flippers may make the production of thrust in water even more difficult.

It is known that different types of swimming flippers exist for different types of use. Scuba divers have special flippers for use in combination with self-contained underwater breathing apparatus. Snorkeling fins are used in conjunction with snorkel gear for a specific use. Typically the flippers for scuba divers have a fin blade which is shaped so as to give adequate thrust for the weight to be moved. Different models of swim flippers have very different rigidities of fin blades depending on the amount of power which the diver is capable of developing with his/her legs and in the sea conditions in which the diver finds himself/herself.

The design and complexity of a swimming fin is usually dictated by the swimming ability and experience of the user. Various models of flipper differ from one another in shape, size and materials of the fin blade and in general in the flipper as a whole. Most fin blades of the swim flipper have considerable rigidity and the shoe for the foot is made of a different material than the material that makes up the blade of the swim flipper. Typically the shoe and the fin are permanently affixed together or are formed as a singular piece.

A problem with the standard type swim fin and/or flipper is that because of the rigidity of the blade of the flipper, it requires considerable effort by the user to produce adequate thrust to propel the individual through water.

Yet another problem exists because the typical swim fin and/or flipper has a rigid blade portion which puts an increased amount of pressure on the biomechanical movement of an individual. More specifically, the typical swim fin that has a rigid blade forces the user to hyper-extend their ankles to provide adequate thrust to propel their weight in a forward motion.

What is needed is a swim flipper that has a joint portion thereon to allow for increased flexibility of the swim flipper.

Further, a need therefore exists for a swim flipper having a joint system on the blade portion of the flipper that may be covered with a flexible material that may allow for increased flexion about the joint area. The increased flexion of the swim flipper may allow the individual to produce more thrust without as much physical effort.

Moreover, a need exists for a swim flipper that may have a joint system that may be a stretch joint with memory for increased thrust and snap as the kick ends.

SUMMARY OF THE INVENTION

The present invention provides a new swim flipper with a unique blade design. More specifically, the present invention provides a new swim flipper that may have a joint system portion positioned on the blade portion of the swim flipper. Additionally, the present invention provides a new swim flipper that may have a joint system portion having a solid core and a rubber covering that may flex about the joint. The present invention also provides a swim flipper that eases the pressure on bio-mechanical movement of the ankle. Moreover, the present invention also provides a new swim flipper that may allow the user to expend less energy in producing adequate thrust to propel the individual through water.

To this end, in an embodiment of the present invention, a swim flipper is provided. The swim flipper has a shoe portion and a blade portion extending away from said shoe portion. The blade portion has an upper surface and a lower surface. The upper surface and said lower surface of the blade are defined by a thickness. Additionally, the swim flipper has a blade portion having at least one lateral edge, the lateral edge extending away from the shoe portion. The lateral edge has a joint system thereon wherein the joint system permits flexion of the blade portion of the swim flipper.

In an embodiment, the swim flipper has a blade portion having a second lateral edge wherein the second lateral edge has a joint system thereon to permit flexion of the blade portion of the swim flipper.

In an embodiment the swim flipper has at least one lateral edge having a top side, a bottom side, an outside edge and an inside edge wherein said inside edge attaches to said blade portion wherein said blade portion extends away from said inside edge of said lateral edge and further wherein said lateral edge has a thickness greater than the thickness of said blade portion.

In an embodiment, the swim flipper has a lateral edge containing the joint system thereon and wherein said joint system is located at the mid-point of the lateral edge when viewed longitudinally.

In an embodiment, the joint system of said swim flipper has a core and a covering wherein the core is comprised of a rigid material and the covering is comprised of a flexible material.

In an embodiment, the joint system of the swim flipper has a core and a covering wherein the core is comprised of a flexible material and the covering is comprised of a flexible material.

In an embodiment, the joint system of the swim flipper has a core and a covering wherein the core is comprised of plastic and the covering is comprised of rubber wherein said rubber allows for flexion of said joint system.

In an embodiment, the joint system is comprised of rubber wherein said joint system has a core and a covering.

In an embodiment, the swim flipper has a blade that is composed of plastic.

In an embodiment, the swim flipper has a blade that is composed of rubber.

In an embodiment of the present invention a swim flipper is provided. The swim flipper has a shoe portion fitted to accept the foot of an individual. Additionally, the swim flipper has a blade portion extending away from said shoe portion having an upper surface and a lower surface, said upper surface and said lower surface defining a thickness. Moreover, the swim flipper has a blade portion having a joint system thereon wherein said joint system permits flexion of the blade portion of the swim flipper. The joint system is located at the midpoint of the blade portion.

In an embodiment, said blade portion of the swim flipper has at least one lateral edge having a top side, a bottom side, an outside edge and an inside edge wherein said inside edge attaches to said blade portion wherein said blade portion extends away from said inside edge of said lateral edge and further wherein said lateral edge has a thickness greater than the thickness of said blade portion.

In an embodiment, the swim flipper has a joint system having a core and a covering wherein the core is comprised of a rigid material and said covering is comprised of a flexible material.

In an embodiment, the joint system of the swim flipper has a core and a covering wherein said core is comprised of a flexible material and said covering is comprised of a flexible material.

In an embodiment, the joint system of the swim flipper has a core and a covering wherein said core is comprised of plastic and said covering is comprised of rubber wherein said rubber allows for flexion of the joint system.

In an embodiment, the swim flipper has a joint system having a core and a covering wherein said core is comprised of plastic and said covering is comprised of rubber.

In an embodiment, the joint system of the swim flipper is comprised of rubber wherein said joint system has a core and a covering.

In an embodiment, the blade of the swim flipper may contain a plurality of joint systems thereon.

In an embodiment, the swim flipper has at least one lateral edge of the blade portion having a joint system contained thereon wherein the joint system has a thickness greater than the thickness of the remainder of the lateral edge.

In an embodiment of the present invention, there is provided a method of using a swim flipper, comprising the steps of: providing a swim flipper having a shoe portion and a blade portion; providing a swim flipper having a blade portion having at least one lateral edge wherein said lateral edge has a joint system contained thereon to aid in flexion of the blade portion.

In an embodiment, the method of using a swim flipper further comprises the step of inserting the foot into the shoe portion.

In an embodiment, the method of using a swim flipper further comprises the step of establishing a kicking motion with the legs of an individual to effectuate movement of the blade in water wherein the kicking motion in the water will cause the blade to flex about the joint system, providing greater thrust against the water to propel the individual through the water.

It is, therefore, an advantage of the present invention to provide a unique swim flipper.

Another advantage of the present invention is to provide a unique swim flipper with a unique blade design.

Still another advantage of the present invention is to provide a unique swim flipper with a unique blade design wherein the unique blade may have a streamlined design.

Yet another advantage of the present invention is to provide a unique swim flipper with a unique blade design wherein the blade may be composed of plastic.

Another advantage of the present invention is to provide a unique swim flipper with a unique blade design wherein the blade may be composed of rubber.

Still another advantage of the present invention is to provide a unique swim flipper with a unique blade design wherein the blade may be composed of any resilient material.

An advantage of the present invention is to provide a unique swim flipper with a unique blade design wherein the blade may be composed of a substantially rigid material.

Yet another advantage of the present invention is to provide a unique swim flipper with a unique blade design wherein the blade may be made of a flexible material.

Still another advantage of the present invention is to provide a swim flipper with a unique blade design wherein the blade design may have a joint system contained thereon.

Another advantage of the present invention is to provide a unique swim flipper with a unique blade design wherein the blade may have a unique joint system contained thereon wherein the joint system may be comprised of a material different than the material than that of the blade.

Yet another advantage of the present invention is to provide a unique swim flipper with a unique blade design wherein the blade may have a joint system contained thereon wherein the joint system increases the entire blade flexibility.

An advantage of the present invention is to provide a unique swim flipper with a unique blade design wherein the blade may have a joint system contained thereon wherein the joint system may decrease the amount of hyper-extension of the ankle needed by the user to provide thrust.

Still another advantage of the present invention is to provide a unique swim flipper with a unique blade design wherein the blade may have a joint system contained thereon wherein the joint system may increase the amount of thrust produced by a stoke of an individual.

Yet another advantage of the present invention is to provide a unique swim flipper with a unique blade design wherein the blade may have a joint system contained thereon wherein the joint system may decrease the amount of force exerted by an individual to produce thrust in water.

Still another advantage of the present invention is to provide a unique swim flipper with a unique blade design wherein the blade may have a joint system contained thereon wherein the joint system may allow the blade to flex about the joint system.

Another advantage of the present invention is to provide a unique swim flipper with a unique blade design wherein the blade may have a joint system contained thereon wherein the joint system may allow a portion of the blade to flex.

A further advantage of the present invention is to provide a unique swim flipper with a unique blade design wherein the blade may have a joint system contained thereon wherein the joint system may allow a portion of the blade to remain rigid while allowing a second portion of the blade to flex vertically about the plane of the blade.

Yet another advantage of the present invention is to provide a unique swim flipper with a unique blade design wherein the blade of the swim flipper may have a joint system contained thereon wherein the joint system may be comprised of a plurality of materials.

Still another advantage of the present invention is to provide a unique swim flipper with a unique blade design wherein the blade may have a joint system contained thereon wherein the joint may have a solid core.

An advantage of the present invention is to provide a unique swim flipper with a unique blade design wherein the blade may have a joint system contained thereon wherein the joint may have a core that may be rigid.

Yet another advantage of the present invention is to provide a unique swim flipper with a unique blade design wherein the blade may have a joint system contained thereon wherein the joint may have a core that is flexible.

Another advantage of the present invention is to provide a unique swim flipper with a unique blade design wherein the blade may have a joint system contained thereon wherein the joint may have a core that is made of rubber.

Still another advantage of the present invention is to provide a unique swim flipper with a unique blade design wherein the blade may have a joint system contained thereon wherein the joint may have a core that is made of plastic.

An advantage of the present invention is to provide a unique swim flipper with unique blade design wherein the blade may have a joint system contained thereon wherein the joint may have a core that may be made of any rigid material.

Yet another advantage of the present invention is to provide a unique swim flipper with a unique blade design wherein the blade may have a joint system contained thereon wherein the joint may have a core that may be made of an flexible material.

Still another advantage of the present invention is to provide a unique swim flipper with a unique blade design wherein the blade may have a joint system contained thereon wherein the joint may have a core made of solid material and a covering over the core that may be made of rubber.

Another advantage of the present invention is to provide a unique swim flipper with a unique blade design wherein the blade may have a joint system contained thereon wherein the joint may have a core made of a solid material and a covering over the core that may be made of any flexible material.

A further advantage of the present invention is to provide a unique swim flipper with a unique blade design wherein the blade may have a joint system contained thereon wherein the joint may have a core made of a solid material and a covering over the core that may be made of any flexible material wherein the covering may flex about the core.

Still another advantage of the present invention is to provide a unique swim flipper with a unique blade design wherein the blade may have a joint system wherein the joint system is located in the center of the blade.

Yet another advantage of the present invention is to provide a unique swim flipper with a unique blade design wherein the blade may have a joint system wherein the joint system is located in close proximity to the shoe portion.

Still another advantage of the present invention is to provide a unique swim flipper with a unique blade design wherein the blade may have a joint system contained thereon wherein the joint system may be located anywhere on the blade portion.

Another advantage of the present invention is to provide a unique swim flipper with a unique blade design wherein the blade may have a plurality of joint systems contained on the blade.

A further advantage of the present invention is to provide a unique swim flipper with a unique blade design wherein the blade may have a joint system contained thereon wherein the joint system may increase flexibility of the entire swim flipper.

Yet another advantage of the present invention is to provide a unique swim flipper with a unique blade design wherein the blade may have a joint system contained thereon wherein the joint system may increase the speed in which a swimmer may travel through the water.

Still another advantage of the present invention is to provide a unique swim flipper with a unique blade design wherein the blade may have a joint system contained thereon wherein the joint system may allow the user to utilize less physical force when traveling through the water.

Still another advantage of the present invention is to provide a unique swim flipper with a unique blade design wherein the blade may be detachably connected to a shoe portion of the swim flipper.

An advantage of the present invention is to provide a unique swim flipper with a unique blade design wherein the blade portion may be releasably attached to the shoe portion of the swim flipper.

Another advantage of the present invention is to provide a unique swim flipper with a unique blade design wherein the blade portion and the shoe portion are formed into a single piece construction.

Yet another advantage of the present invention is to provide a unique swim flipper with a unique blade design wherein the swim flipper may provide for easier movements in water.

Another advantage of the present invention is to a unique swim flipper with a unique blade design wherein the swim flipper helps to develop leg strength of an individual.

Another advantage of the present invention is to provide a unique swim flipper with a unique blade design wherein the swim flipper is of streamlined design.

Still another advantage of the present invention is to provide a unique swim flipper with a unique blade design wherein the swim flipper makes swimming through water easier for a swimmer.

These and other objects of the invention will become more clear when one reads the following specification, taken together with the drawings that are attached hereto.

The scope of protection sought by the inventors may be gleaned from a fair reading of the Claims that conclude this specification.

Additional features and advantages of the present invention are described in, and will be apparent from, the detailed description of the presently preferred embodiments and from the drawings.

DESCRIPTION OF THE PREFERRED EMBODIMENT

Figure 1:
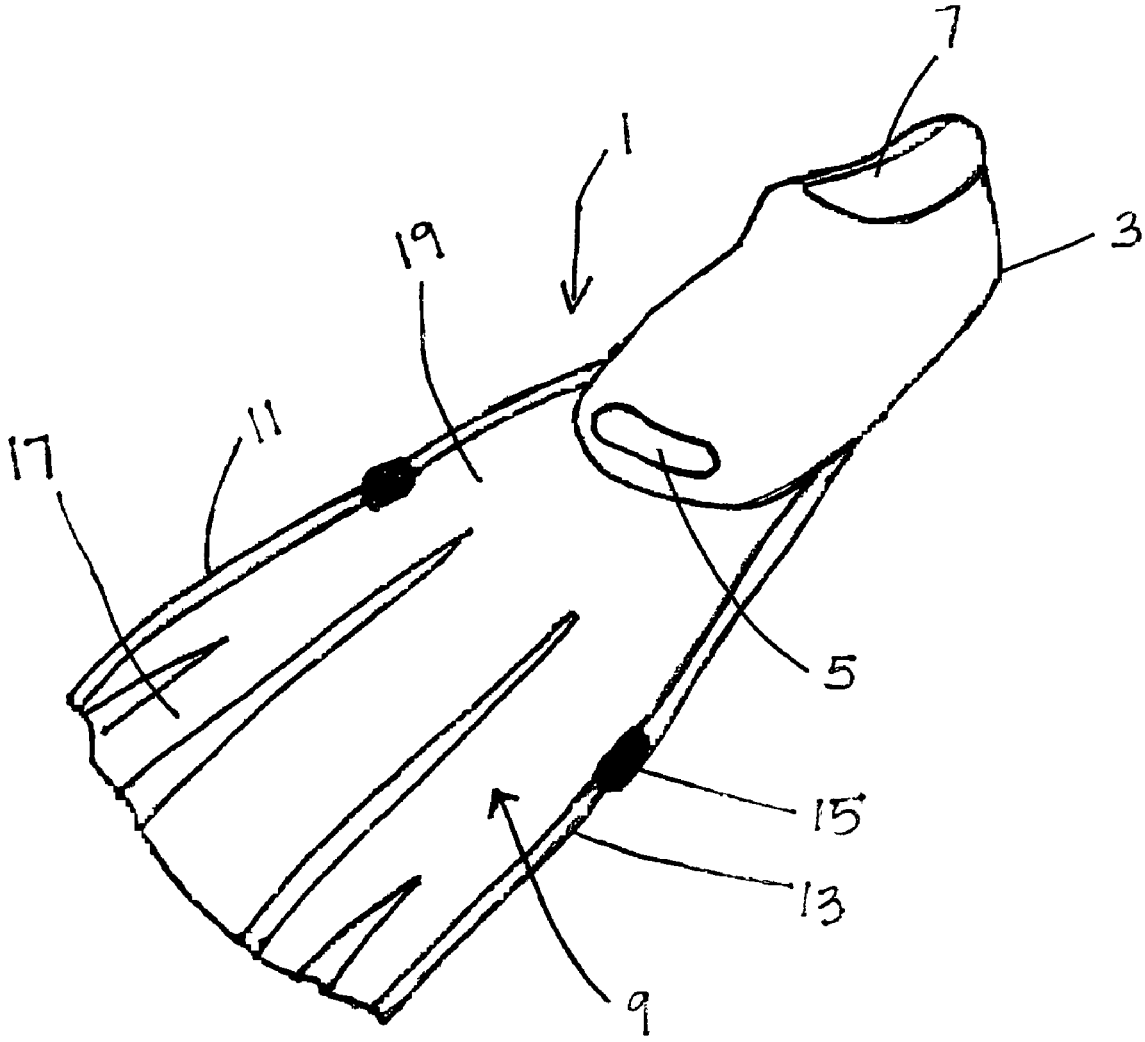
FIG. 1 is a perspective view of the swim flipper in an embodiment of the present invention.

Turning now to the drawings wherein elements are identified by numbers and like elements are identified by like numbers throughout the 5 FIGS, the invention is depicted in FIG. 1 that shows a swimming flipper 1.

The swim flipper 1 may have a plurality of sections that define the entire flipper 1. The flipper 1 may have a shoe portion 3 that may be fitted to receive the foot (not shown) of an individual (not shown) that is using the flipper 1. The shoe portion 3 may have an opening 5 therein to allow water to flow through the opening 5. The opening 5 may make draining of the shoe portion 3 easier when the user has exited the water. Moreover, the opening 5 may allow for easier ingress and exit of the foot from the shoe portion 3. The opening 5 may also help with the aerodynamics of the flipper 1 during movement of the flipper 1 in the water. The shoe portion 3 may have a second opening 7 that may allow for ingress and exit of an individual's foot (not shown) into and out of the shoe portion 3.

The flipper 1 may also have a blade portion 9 attached to the shoe portion 3 to form the entirety of the swim flipper 1. The blade portion 9 may be detachably connected to the shoe portion 3, allowing for interchangeablity of the blade portion 9 with respect to the shoe portion 3. In a preferred embodiment of the present invention, the blade portion 9 of the swim flipper 1 is permanently affixed to the shoe portion 3 to create a single piece unit.

The blade portion 9 of the swim flipper 1 may be constructed of any material. In the preferred embodiment of the present invention, the blade portion 9 will be made from a plastic material. However, the blade portion 9 may be made from any polyfiber, rubber, and/or material of a flexible nature. The blade portion 9 may also have a first lateral edge 11 and a second lateral edge 13. The first lateral edge 11 and the second lateral edge 13 may be opposed to each other and may be separated by the rest of the blade portion 9 of the swim flipper 1. The lateral sides, including the first lateral edge 11 and the second lateral edge 13, may have a joint system 15 contained thereon. The joint system 15 may be used to increase the flexion of the blade portion 9 in relation to a rigid blade. The joint system 15 may also allow the whole blade portion 9 to flex about the joint system 15. Moreover, the joint system 15 may increase the amount of thrust created by an individual using the same amount of force as those swim flippers that do not have the joint system 15. The joint system 15 may allow a first end 17 of the blade portion 9 to move in a vertical plane with respect to a second end 19 of the blade portion 9.

Figure 2:
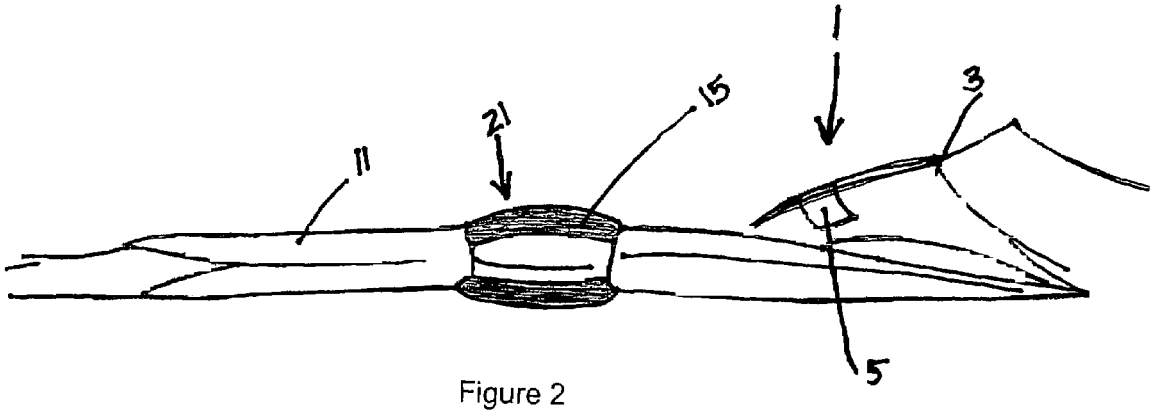
FIG. 2 is a side view of the of the swim flipper in an embodiment of the present invention.

As illustrated in FIG. 2, the first lateral edge 11, or second lateral edge 13, may have a joint system 15 contained thereon. The joint system 15 may have a diameter larger than the diameter of the first lateral edge 11, or second lateral edge 13, of the swim flipper 1. In a preferred embodiment, the joint system 15 may be positioned at the mid point 21 of the first lateral edge 11, or second lateral edge 13. However, the joint system 15 may be positioned anywhere on the lateral edge 11, 13 to provide greater thrust to an individual while in water. Moreover, in a preferred embodiment of the present invention, the first lateral edge 11, or second lateral edge 13 may have a singular joint system contained thereon. However, the first lateral edge 11, or second lateral edge 13, may contain a plurality of joint systems 15 thereon to further create thrust during use.

Figure 3:
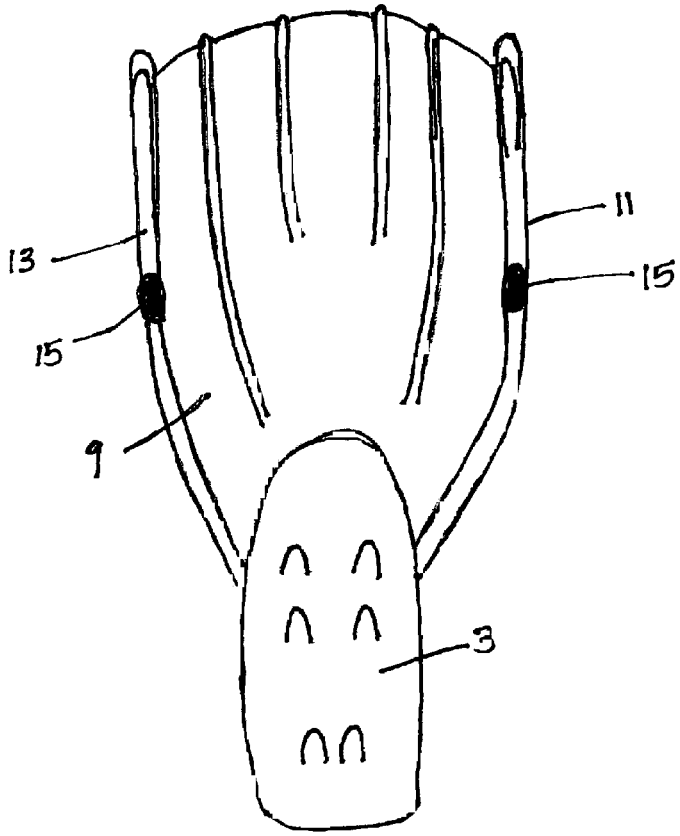
FIG. 3 is a bottom view of the swim flipper in an embodiment of the present invention.
Figure 4:
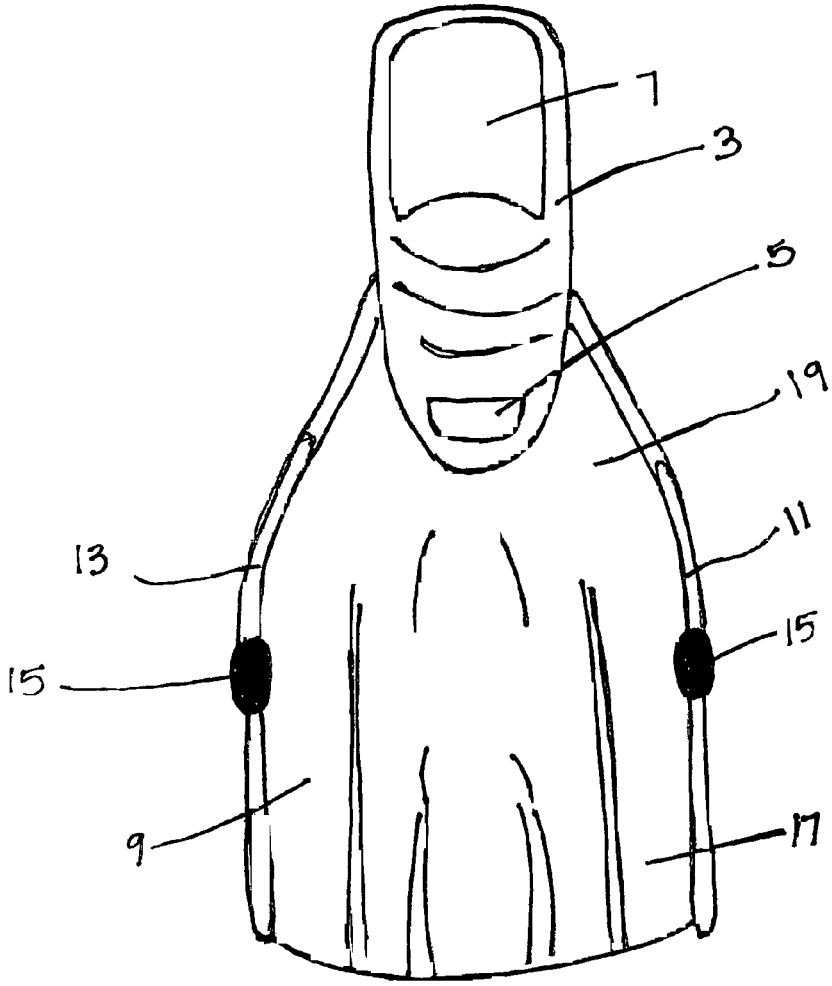
FIG. 4 is a top view of the swim flipper in an embodiment of the present invention.

FIG. 3 illustrates a bottom view of the swim flipper 1. FIG. 4 illustrates a top view of the swim flipper 1. As illustrated in FIGS. 3 and 4, the joint system 15 is positioned on the lateral edge 11, 13 of the blade portion 9. The joint system 15 is preferably positioned on at least one of said first lateral edge 11, or second lateral edge 13, of the swim flipper 1, but may be positioned at any point on the blade portion 9 or may extend from the first lateral edge 11 to the second lateral edge 13 of the swim flipper 1. As further illustrated in FIG. 3, the joint system 15 may allow the blade portion 9 to flex vertically in both a positive and negative axis. The flexion of the blade portion 9 in both the negative and positive axis may provide greater thrust when utilized by an individual (not shown) in water.

Figure 5:
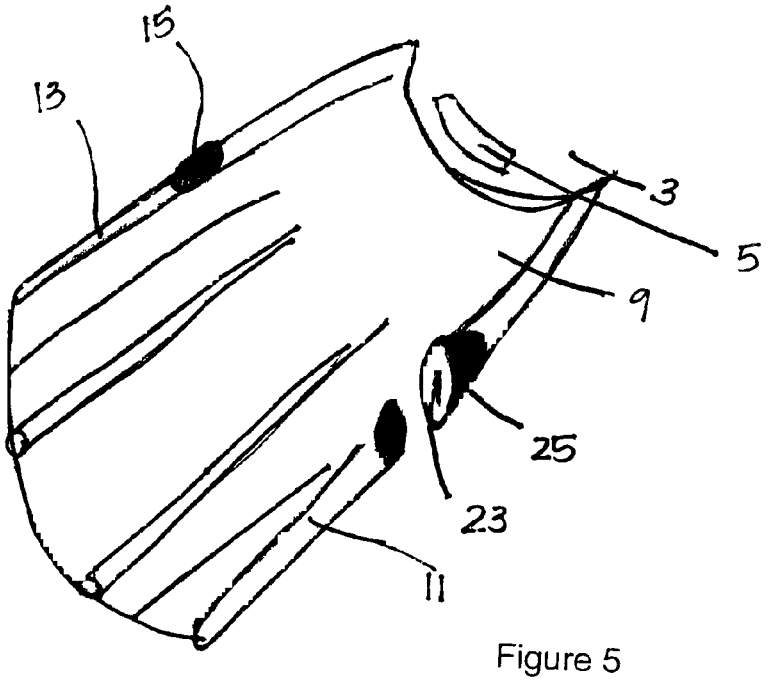
FIG. 5 is a close up perspective cross sectional view of the swim flipper in an embodiment of the present invention.

FIG. 5 illustrates a cross-sectional perspective view of the swim flipper 1. FIG. 5 illustrates the shoe portion 3 of the swim flipper 1 connected to the blade portion 9 of the swim flipper 1. The blade portion 9 has a first lateral edge 11 and a second lateral edge 13 contained thereon. The first lateral edge 11 and the second lateral edge 13, may have a joint system 15 contained thereon wherein the joint system 15 may be at the midpoint 21 of the first lateral edge 11 and/or the second lateral edge 13. FIG. 5 illustrates a cross-sectional view of the joint system 15. The joint system 15 may have a plurality of parts. In a preferred embodiment of the present invention, the joint system 15 may have a rigid core 23 which may be surrounded by a covering 25. In a preferred embodiment, the rigid core 23 may be plastic and the covering 25 would be flexible in nature. The core 23 may be constructed of any rigid material. In another embodiment of the present invention, the core 23 may be constructed of any flexible material that may assist the joint system 15 in flexion. In a preferred embodiment of the present invention, the covering 25 of the joint system 15 would be constructed of flexible material. The flexible material may be rubber. However, the covering 25 may be composed of any flexible material that may allow the joint system 15 to flex.

It should be understood, however, that modifications to the presently preferred embodiments described herein will be apparent to those skilled in the art. Such changes and modifications may be made without departing from the spirit and scope of the present invention and without diminishing its attendant advantages.

What is claimed is:

1. A swimming flipper, comprising:

a shoe portion;

a blade portion extending away from said shoe portion having an upper surface and a lower surface;

said blade portion having a first lateral edge, said lateral edge extending away from said shoe portion; and, a joint system positioned on said first lateral edge wherein said joint system permits flexion of the blade portion of the swimming flipper and includes a core and a core covering wherein said core is comprised of a rigid material and said core covering is comprised of a flexible material.

2. A swimming flipper, comprising:

a shoe portion;

a blade portion extending away from said shoe portion having an upper surface and a lower surface;

said blade portion having a first lateral edge, said lateral edge extending away from said shoe portion; and, a joint system positioned on said first lateral edge wherein said joint system permits flexion of the blade portion of the swimming flipper and includes a core and a core covering wherein said core is comprised of a flexible material and said core covering is comprised of a flexible material.

3. A swimming flipper, comprising:

a shoe portion;

a blade portion extending away from said shoe portion having an upper surface and a lower surface;

said blade portion having a first lateral edge, said lateral edge extending away from said shoe portion; and, a joint system positioned on said first lateral edge wherein said joint system permits flexion of the blade portion of the swimming flipper and includes a core and a core covering wherein said core is comprised of a plastic material and said core covering is comprised of a rubber material.

4. A swimming flipper, comprising:

a shoe portion;

a blade portion extending away from said shoe portion having an upper surface and a lower surface;

said blade portion having a first lateral edge, said lateral edge extending away from said shoe portion; and, a joint system positioned on said first lateral edge that permits flexion of said blade portion of the swimming flipper and is comprised of rubber and has a core and a core covering wherein said rubber allows for flexion of the blade.

* * * * *